United States Patent [19]

Fischer

[11] Patent Number: 4,605,209

[45] Date of Patent: Aug. 12, 1986

[54] LONGITUDINAL FOLDING APPARATUS FOR TRAVELING WEBS, PARTICULARLY PAPER WEBS RECEIVED FROM A ROTARY PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 697,734

[22] Filed: Feb. 4, 1985

[30] Foreign Application Priority Data

Feb. 9, 1984 [DE] Fed. Rep. of Germany ..... 3404551

[51] Int. Cl.[4] ..... B41L 1/30

[52] U.S. Cl. ..... 270/40; 400/616.3; 226/81

[58] Field of Search ..... 270/5, 40; 400/616.3; 226/76–77, 82, 87, 81, 75, 52, 54–56

[56] References Cited

U.S. PATENT DOCUMENTS

| | | | |
|---|---|---|---|
| 1,385,569 | 7/1921 | Mayer et al. | 270/40 |
| 2,102,651 | 12/1937 | Sherman et al. | 226/81 |
| 2,107,462 | 2/1938 | Wood | 270/5 X |
| 3,410,469 | 11/1968 | Deeg | 226/81 |
| 3,448,906 | 6/1969 | Walsh et al. | 226/75 |

FOREIGN PATENT DOCUMENTS

| | | | |
|---|---|---|---|
| 835689 | 7/1949 | Fed. Rep. of Germany | 226/81 |
| 470857 | 8/1937 | United Kingdom | 270/5 |

*Primary Examiner*—E. H. Eickholt

*Attorney, Agent, or Firm*—Frishauf, Holtz, Goodman & Woodward

[57] ABSTRACT

To permit easy threading of a plurality of paper webs through rollers which have projecting pins thereof to provide for positive feed of the paper webs by perforating the paper webs, the pins are located such that they can be selectively positioned below a cylindrical generated outline defined by the largest radial dimension of at least one of the engagement rollers, for example by being selectively retractable (FIG. 1) within the outline of the cylindrical roller, or by being located (FIG. 2) in flutes or depressions of fluted rollers. If the pins are selectively retractable and projectionable, preferably, a positioning cone (5) is located within a hollow roller (1), the axial position of the cone being determined by an external hand wheel (23) which, over a rod (4), axially positions the cone, while including a rotation-isolating coupling (14–22) between the hand wheel and the rod (4). The rollers may be located upstream, or downstream of the folding former, or in both positions, thereby functioning as supply or pull-off rollers, respectively.

19 Claims, 2 Drawing Figures

LONGITUDINAL FOLDING APPARATUS FOR TRAVELING WEBS, PARTICULARLY PAPER WEBS RECEIVED FROM A ROTARY PRINTING MACHINE

Reference to related application, assigned to the assignee of the present invention, the disclosure of which is hereby incorporated by reference:

U.S. Ser. No. 677,171, filed Dec. 3, 1984, refiled under Ser. No. 817,156,Jan. 7, 1986, as a Continuation application, by the inventor hereof.

The present invention relates to a longitudinal folding apparatus, such as a folding funnel or folding triangle, and more particularly to an apparatus which includes pull-off rollers positively pulling off folded printed copy material delivered from a rotary printing machine, and especially to an improvement of the structure described in U.S. application Ser. No. 677,171, filed Dec. 3, 1984, refiled as a Continuation, Ser. No. 817,156, Jan. 7, 1986, by the inventor hereof.

BACKGROUND

The referenced, earlier application 06/677,171, filed Dec. 3, 1984, describes a longitudinal folding apparatus for use with rotary printing machines having a folding triangle or folding former, feed or supply rollers to which a plurality of superposed webs, for example paper webs delivered from a rotary printing machine, are supplied. Printing machines, as ist customary, print on, and hence supply unperforated webs. To provide for accurate placement of the paper webs above each other, for example upon folding, the supply rollers and/or the pull-off rollers have engagement projections extending therefrom, for example pins, which are dimensioned to pass the various superposed webs, so that registry of the respective webs is maintained. These pins may be pointed needles and when assembled on a roller, the roller may be termed a "prickly roller".

It has been found that it is difficult to thread a folding arrangement of this type since the projections, particularly if in the form of needle-like pins, interfere with threading of the webs through the apparatus before it is actually placed in operation.

THE INVENTION

It is an object to improve a folding apparatus, especially suitable for use with printing machines, such that the threading of the forming apparatus is facilitated, while maintaining the advantages of accurate register of superposed webs.

Briefly, the supply and/or pull-off rollers are formed with Briefly, a supply and/or pull-off roller, over which the web is passed, in contact with the circumference of the roller, is formed with generatrix defined by the cylindrical outline of the largest radial dimension of the respective roller. This can be achieved, for example, by providing pins on the rollers which are retractable or projectionable, as desired; in one simple mechanism, the pins are located circumferentially around the roller, spring-biassed to be retracted, and engaged inwardly of the roller by a cone which, depending on the axial position thereof, presses the pins outwardly. For threading, the pins are permitted to be recessed, thus forming a clear zone between the pin carrying roller and the web being passed over the roller. In operation the cone is moved into a position to press the pins outwardly to engage the webs. In accordance with another embodiment of the invention, the rollers have fluted or corrugated or wavy surface configurations, defining lands between depressed flutes. The projections, such as pins or needles, are located in the depression, and the fluted roller cooperates with a similarly fluted counter roller, positionable such that the lands of the cooperating roller, in operation, engage in the flutes of the pin-equipped roller to press the webs against the pins. For threading, the pin-equipped roller can be so positioned that lands are located at the outer circumference, thus preventing contact of paper webs to be threaded with the projecting tips of the pins, the counter roller being positioned to place the contact zone of the paper web with the periphery of the roller only on the pinless lands of the pin-carrying roller.

The invention has the advantage to insure registry and synchronous running of all superposed webs which are folded in a folder by a folding former or folding triangle or funnel, while permitting threading of the web easily and simply and preventing misalignment of one of the webs with respect to another by possible premature or unintentional contact of a web with one or more of the projections or pins.

DRAWINGS

FIG. 1 is a schematic, part-pictorial longitudinal sectional view through a roller used in accordance with the present invention, including its bearing arrangement; and FIG. 2 is a schematic front view of the arrangement showing another embodiment of the invention.

DETAILED DESCRIPTION

Figure 1:
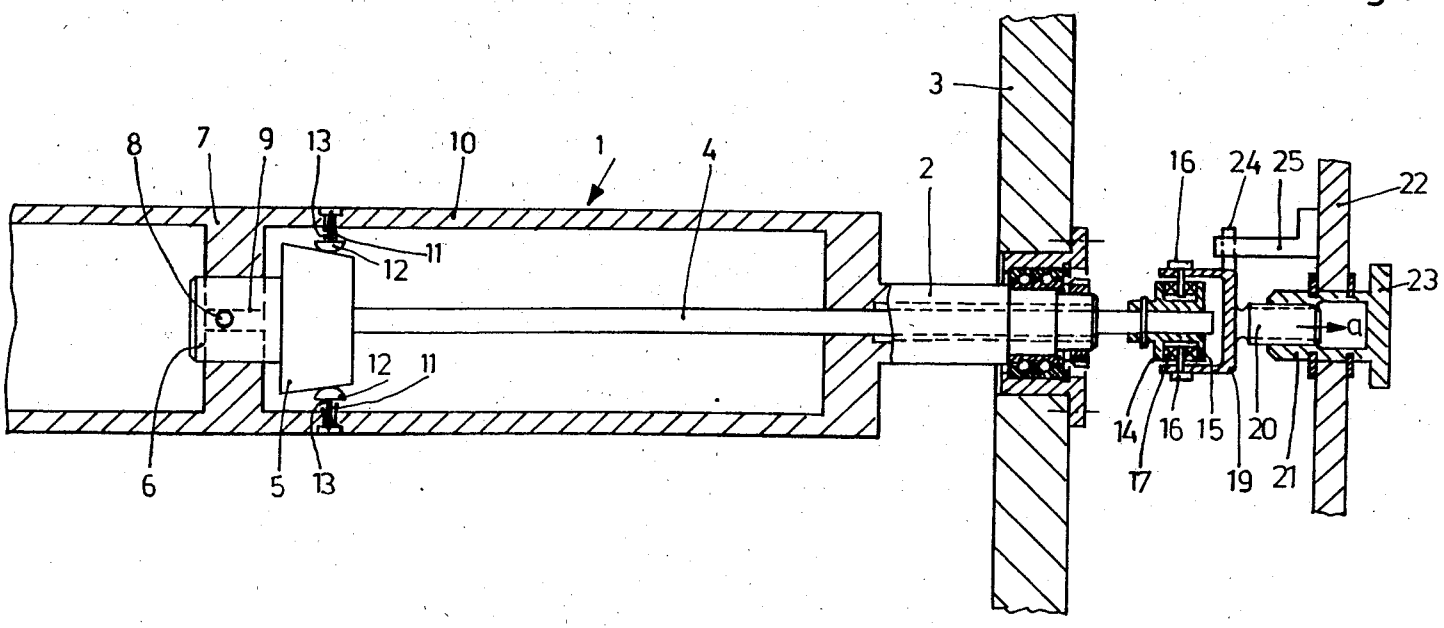

The roller illustrated in FIG. 1 can be used as a pull-off roller, similar to the rollers 30, 31 (FIG. 2), or a supply or feed roller, similar to the roller 27 (FIG. 2), that is, can be located ahead of or behind the folding former triangle 26 (FIG. 2) as desired. A plurality of webs are to be fed over the folding triangle and former 26; the webs are not shown since they can be placed and fed on the former in accordance with any well known and suitable construction, as received, for example, from a rotary printing machine having multiple printing stations.

The roller 1—FIG. 1—which may be a supply feed roller, or a pull-off roller—has a shaft stub 2 which is journalled in a side wall 3 of the machine. The left side of the bearing arrangement—with respect to FIG. 1—is not shown and may be in accordance with any suitable construction, and, if a second set of projections or pins is desired, may be the mirror image of the arrangement shown in FIG. 1. The roller 1 is hollow and receives a positioning rod 4 in its interior. The rod 4 has a conical control element 5 securely attached thereto. The end of the rod 4 which is remote from the stub 2 is journalled in a cross element 7 of the roller 1 by a cylindrical attachment 6, and secured against rotation with respect to the roller 1 by a pin 8 which engages a groove 9 in the cross element 7 which, for example, may be a spider, a pin, or a cross bar with a central enlargement. The cylindrical attachment 6, and hence the positioning rod 4, with the control element 5 thereon, thus can move axially but cannot rotate relative to the roller 1.

The control element 5 is in form of a cone or a frusto-conical element. In the region of the cone, the roller 1 has radial bores formed in the outer wall 10 thereof. Pin-like or needle-like projection elements 11 are inserted in the openings in the wall 10. Each one of the projections 11 has a dished engagement end 12 at the side facing the control cone 5. A compression spring 13 is located between the dished engagement element 12 and the inner surface of the wall 10, tending to retract the pin 11 into the outer circumference or the generated surface of the roller 1, and further holding the pin 11 in engagement with the conical control element 5.

The end of the rod 4 which is remote from the control element is formed with, or has two flanges 14, 15 attached thereto. A plurality of engagement pins 16 engages in the space between the flanges. Each one of the engagement pins 16 is formed with a radial bearing 17, the outer circumference of which fills the space between the flanges 14, 15. The pins 16 are secured to a cup-shaped carrier 19 which surrounds the flanges 14, 15 and is attached to a threaded pin or bolt extension 20. The bolt extension 20 is threaded into a nut or threaded bushing 21, which is freely rotatable, but secured against longitudinal movement in an outer side wall portion 22, secured, for example, in a cup-shaped arrangement (not shown) to the main side wall 3 of the machine. A hand wheel 23 is secured to the bushing or nut 21. A radial extension 24 is secured to the cup-shaped carrier 19 which engages between a pair of rails 25, secured to the wall 22, so that the cup-shaped carrier can move axially, that is, with respect to FIG. 1 between left and right, but cannot rotate.

OPERATION

FIG. 1 shows the roller 1 in the position in which the projecting pins 11 are retracted. This is the position for the pins when the folding former is to be threaded, or equipped. None of the projecting pins 11 project from the outer circumference of the wall 10, and paper can freely be passed around the circumference of the roller 10. There is no danger that the projecting pins may catch on the paper. Once all the various webs are pulled over the folding former or folding triangle 26 (FIG. 2) and are, for example, manually aligned and brought into register, and/or brought into register by other means coupled to the printing machine, as well known, and when printing is to be commenced, the hand wheel 23 is rotated so that the threaded pin 20 will be moved in the direction of the arrow a (FIG. 1). This movement also pulls the cup-shaped carrier 19, and hence the bearing pins 16 towards the right (with respect to FIG. 1). The pins 16 carry along, by coupling with the bearings 17, the flange 15, and, hence, move the rod 4 to the right. The control cone 5 now will press the pins 11 by engagement with their engagement dishes 12 towards the outside, and into a position in which the engagement pins will penetrate through the paper of the webs (not shown) which have been threaded over the roller 1.

The extent of rotation of the hand wheel 23—which can be indicated on a suitable scale—can be matched to the thickness and number of the paper webs, so that they are projected, selectively, just enough to reliably pass through the superimposed webs, without, however, extending essentially therefrom. Thus, the extent of projection of the pins 11 can be matched to the paper thickness and number of webs being passed over the roller 1.

EMBODIMENT OF FIG. 2

The folding former 26 has a supply roller 27 which is journalled in suitable bearings in the side walls 28 of the machine. The supply roller 27 is driven in well known form, not further illustrated in the drawing, since drive of such a supply roller is standard engineering practice, for example by gears. Two pull-off rollers 30, 31 are located in the direction of paper webs 29 over the folding former. The pull-off rollers 30, 31 likewise are driven by suitable gears, with the same circumferential surface speed as the supply roller 27.

Figure 2:
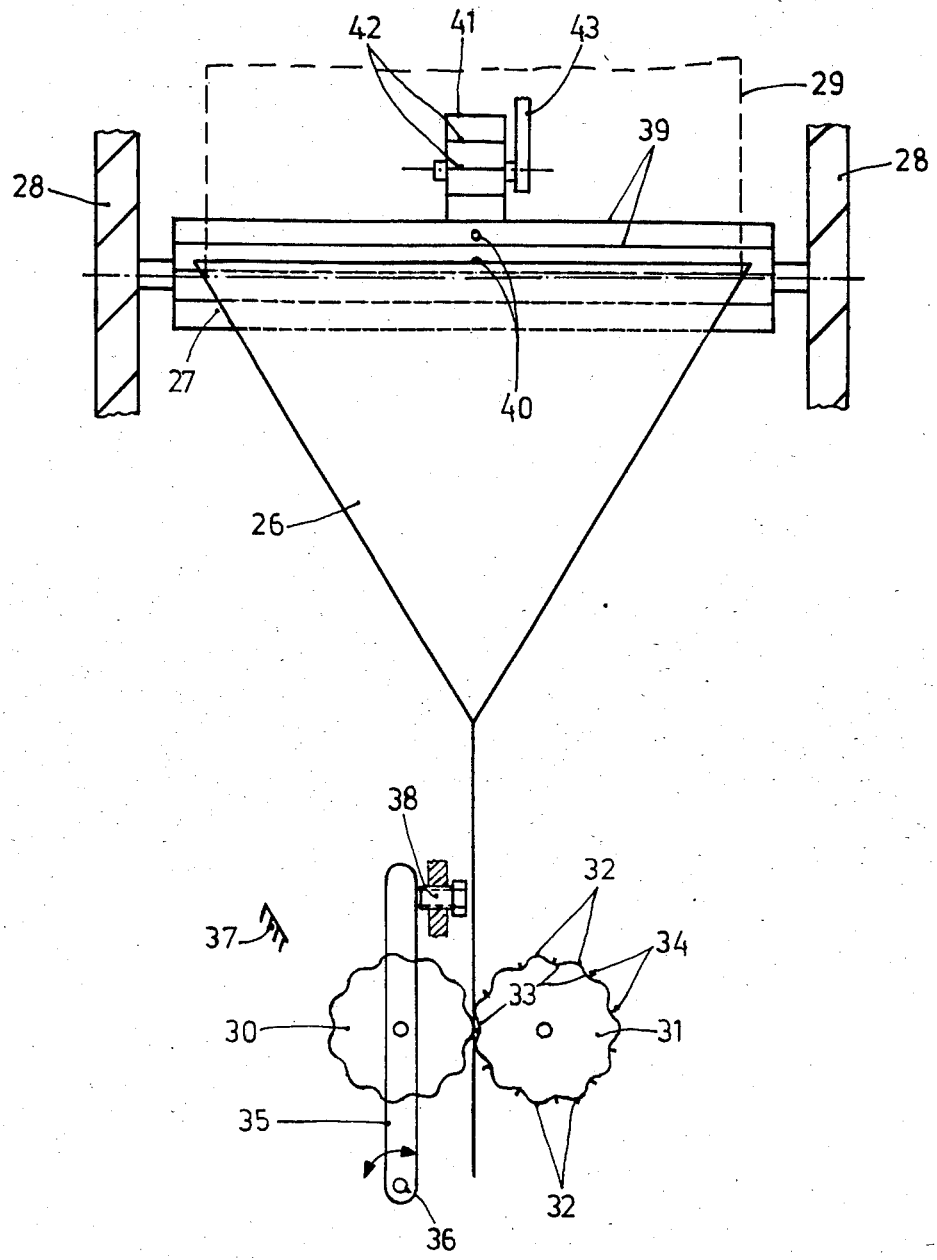

In accordance with a feature of the invention, the rollers 30, 31 do not have a cylindrical circumference but, rather, have a fluted or wavy or corrugated surface, in which, in uniform sequence, flutes or depressions 33 alternate with lands 32. Preferably, the flutes and depressions are undulating or wavy, as best seen in FIG. 2.

One of the rollers, as shown roller 31, has needle-like projections 34 located within the flutes or depressions 33. The projections are located, preferably, at the bottom of the respective flutes or depressions.

At least one of the rollers 30, 31, as shown the roller 30, is journalled between a pair of pivotable links 35—of which only one axial link is seen in the drawing. The links 35 are pivotable about a fixed axis or pivot point 36. The limiting extent of pivoting from the position shown in FIG. 2 is defined by a stop 37, secured, for example, to a side wall of the machine. An adjustable stop 38 is provided for the other limiting position. Suitable holding elements, such as snap catches or engagement levers may be provided, and are not shown since any well known latching arrangement can be used.

OPERATION

Upon threading, the lever 35 is pivoted to the stop 37, thus providing for substantial space between the rollers 30, 31 to pull the webs 29 through and past the rollers. Additionally, the roller 32 can be so positioned that one of the lands 32 faces the side of the webs being pulled through. Since the pins or projections 34 are recessed with respect to the lands 32, by being located in the flutes 33, even that one of the webs 29 which faces the roller 31 cannot catch on the projection 34 and thus interfere with proper threading.

For printing, the roller 30 is then placed into the position shown in FIG. 2, and the roller 31 is so oriented with respect to the roller 30 that a projection 32 on roller 30 will fit into a flute or groove 33 of the roller 31.

The roller 30 as well as the roller 31 may be formed with a metallic surface. In that case, the length of the projecting elements 34 must be suitably dimensioned so that the width of the gap between a land on the roller 30 and a depression 33 of the roller 31 is not exceeded by the length of the pins or projecting elements 34. If the apparatus is to be used with webs in which the thicknesses or the number of superimposed webs changes substantially, it is preferred to utilize projecting elements 34 which are replaceable. Individual adjustment to the overall thickness of the superimposed webs can be obtained by adjusting the adjustment screw of the stop 38.

The example illustrated also shows a supply roller 27 with flutes and lands 39. Projecting elements 40 are located in the flutes. A pressure roller 41 is provided, located in the region of the projecting elements or pins 40. The pressure roller 41, likewise, is formed with projections or lands 42 and intervening flutes or depressions. The supply roller 27 in combination with the pressure roller 41 operate identically to the operation of the pull-off rollers 30, 31. The engagement roller 41 is located, pivotably, on a pivoting lever 43 which, in a manner similar to lever 35, can be pivoted out of engagement with the roller 27. The specific pivoting arrangement of the lever or link 43 is not further illustrated since it can be constructed in any suitable manner, for example identically to that shown in connection with lever 36. Upon threading, the roller 41 is pivoted out of engagement with the roller 27, and roller 27, preferably, is so positioned that one of the projections 39 thereof faces the run-in or threading region of the web 29, so that the pins 40 thereon, only one of which is fully visible in FIG. 2, are securely hidden from engagement with or catching on the webs 29 as they are being threaded.

Various changes and modifications may be made; a plurality of rows of projecting pins can be formed on the supply roller 27 and/or the pull-off roller 31, the projectings, preferably, being located as described in the referenced application Ser. No. 677,171, by the inventor hereof, that is, in a region free from printed subject matter.

I claim:

1. Longitudinal folding apparatus for folding a plurality of unperforated superposed webs (29) over a folding or former funnel or triangle (26), particularly printed paper webs, having at least one paper engaging roller (1, 27, 30, 31) positioned for contact with the webs upon passage of the webs thereover;

engagement penetrating pins (11, 34) positionable on the periphery of the at least one paper engagement roller, the pins having a length just sufficient to perforate said webs;

and comprising means for selectively providing a smooth clear path about the circumference of said roller for threading of the webs thereover, or a path in which said projections or pins engage said webs for positive transport thereby, including means (4, 5, 13, 33) for selectively positioning the engagement pins (11, 34) either below, or projecting above a generated cylindrical outline defined by the largest radial dimension of the at least one engagement roller in the region of contact of the webs over said at least one engagement roller.

2. Apparatus according to claim 1, wherein said selective positioning means comprises means for movably positioning said pins, for selective placement in retracted or projected position with respect to the circumference (10) of the at least one engagement roller (1).

3. Apparatus according to claim 1, wherein said means for selectively positioning said pins comprises spring means (13) coupled to said pins and biassing said pins for retracted position;

and force means (5) selectively positionable for engagement of said pins to project said pins counter the force of said spring means.

4. Apparatus according to claim 3, wherein said pins are selectively radially projectionable or retractable with respect to the circumference (10) of said at least one roller, said at least one roller being formed with openings therein through which said pins may extend or within which said pins may be retracted;

said spring means comprising springs positioned between an inner wall of said circumference, and biassing the pins in an inward direction with respect to said at least one roller;

and wherein said force means comprises an axially shiftable cone (5) engageable with the pins to push the pins counter the force of the spring means, selectively, out of the circumference of the at least one roller when the cone is moved axially.

5. Apparatus according to claim 4, wherein said at least one roller is hollow;

a positioning rod (4) is located within the hollow space of the at least one roller, and coupled to said cone (5) for axially positioning the cone, and hence radially positioning the pins.

6. Apparatus according to claim 5, including axial positioning means (14–25) coupled to the rod (4) to which said cone (5) is attached, comprising bearing means (14, 15, 16, 17) coupled to said rod and separating rotary movement of the rod from axial movement of said bearing means;

and means (19–23) for axially moving the bearing means while permitting rotation of said rod, and hence rotation of said roller, independent of axial shifting of the rod, said bearing means being located on a fixed axial position on said rod (4).

7. Apparatus according to claim 5, including axial positioning means (14–25) coupled to said rod, said axial positioning means comprising a pair of flanges (14, 15) secured to said rod, and spaced from each other;

bearings (16) positioned between said flanges and permitting relative rotation of said flanges, and hence of said rod, without rotation of an outer cage (16, 19) of said bearing;

and axial positioning means (20–25) coupled to said cage for axially positioning said cage and hence said bearing and flanges, and thus moving said rod axially, for positioning of the cone in a selected axial position, and thus controlling the respective selected projection, or retracted position of said pins or projections.

8. Apparatus according to claim 1, wherein said selective positioning means in the region of contact of the webs over said at least one engagement roller comprises a peripheral surface arrangement of said engagement roller (31) which defines an undulating, fluted or corrugated or wavy surface having depressions (33) located between lands (32);

the engagement pins (34) being located in said depressions (33) of said engagement roller; and a counter roller (30) having a matching surface arrangement with depressions located between lands, said engagement roller and said counter roller being selectively circumferentially positionable with respect to each other for selected engagement of the lands of one roller with the depressions of the other roller when the webs are to be fed between the rollers, or, selectively, for displacement of the rollers from each other when the webs are to be threaded between the rollers.

9. Apparatus according to claim 8, wherein the length of the pins at most corresponds to the distance of the width of a gap between the lands of said engagement roller carrying said pins (34, 40) and the matching groove or depression or flute of the counter roller (30, 41) when in operating position.

10. Apparatus according to claim 8, wherein the spacing of the engagement of the lands of one of the rollers (27, 31) and the depressions or flutes of the other roller (30, 41) is adjustable and includes an adjustment stop element (38).

11. Apparatus according to claim 8, wherein the pins (34) comprise a plurality of sets of different lengths.

12. Apparatus according to claim 1, wherein at least two rollers are provided, one of which forms said paper engagement roller; and wherein the rollers are pull-off rollers located downstream—with respect to travel of said webs—over the folding former or folding triangle.

13. Apparatus according to claim 1, wherein at least two rollers are provided, one of which forms said paper engagement roller; and wherein said rollers are feed rollers located upstream—with respect to travel of the webs—over the folding former or triangle.

14. Apparatus according to claim 2, wherein at least two rollers are provided, one of which forms said paper engagement roller; and wherein the rollers are pull-off rollers located downstream—with respect to travel of said webs—over the folding former or folding triangle.

15. Apparatus according to claim 2, wherein at least two rollers are provided, one of which forms said paper engagement roller; and wherein said rollers are feed rollers located upstream—with respect to travel of the webs—over the folding former or triangle.

16. Apparatus according to claim 8, wherein at least two rollers are provided, one of which forms said paper engagement roller; and wherein said rollers are feed rollers located upstream—with respect to travel of the webs—over the folding former or triangle.

17. Apparatus according to claim 8, wherein at least two rollers are provided, one of which forms said paper engagement roller; and wherein said rollers are feed rollers located upstream—with respect to travel of the webs—over the folding former or triangle.

18. Longitudinal folding apparatus for folding a plurality of unperforated superposed printed webs (29) over a folding former or triangle (26), in which the printing is arranged in columns on said webs, leaving longitudinal unprinted strips, said apparatus having paper engaging pull-off rollers (30. 31) located downstream—with respect to travel of the webs—on the folding former or triangle, and positioned adjacent each other defining a nip therebetween for passage of said webs therethrough;

and engagement pins (34) positioned on the circumference of at least one of the paper engaging pull-off rollers, said pins being located on said rollers at a location coinciding with the unprinted strip on said webs, the pins having a length just sufficient to perforate said webs.

19. Apparatus according to claim 18, including means for threading a plurality of paper webs through said pair of rollers comprising means (4, 5, 13, 33) for selectively positioning the engagement pins (34) below a cylindrical generated outline defined by the largest radial dimension of said at least one of said engagement pull-off rollers.

* * * * *